US005109878A

United States Patent [19]

Kuo-Hua

[11] Patent Number: 5,109,878

[45] Date of Patent: May 5, 1992

[54] HAIRCLIP

[76] Inventor: Chou Kuo-Hua, No. 15, Alley 10, Lane 118, Szu Wei Road, Wu Ku Hsiang, Taipei County, Taiwan

[21] Appl. No.: 713,294

[22] Filed: Jun. 11, 1991

[52] U.S. Cl. ..... 132/279

[51] Int. Cl.[5] ..... A45D 8/28

[58] Field of Search ..... 132/276, 277, 278, 279

[56] References Cited

U.S. PATENT DOCUMENTS

| | | | |
|---|---|---|---|
| 2,921,589 | 1/1960 | Blomme | 132/279 |
| 3,805,813 | 4/1974 | Laughton | 132/279 |
| 3,841,340 | 10/1974 | Solomon | 132/279 |
| 4,919,155 | 4/1990 | Yasuda | 132/279 |
| 4,976,277 | 12/1990 | Yasuda | 132/279 |
| 4,991,607 | 2/1991 | Chen | 132/279 |

FOREIGN PATENT DOCUMENTS

| | | | |
|---|---|---|---|
| 2207047 | 1/1989 | United Kingdom | 132/279 |

*Primary Examiner*—John J. Wilson
*Assistant Examiner*—Frank A. LaViola

[57] ABSTRACT

An improved structure hairclip comprising an elongate and arcuate upper piece and lower piece. A pair of pivots disposed on the left end of the lower piece are engaged with a pair of pivot holes disposed on the corresponding end of the upper piece. A locking mechanism, disposed on the opposite end of the upper piece, has a pair of L-shaped wipers with three pairs of locking recesses formed thereon. The L-shaped wipers of the locking mechanism can releasable engage a hasp formed on the right end of the lower piece, to lock the upper piece to the lower piece in any of three relative positions. Two holder bars extend along the midsection of the lower piece, between the pivots and the hasp, on the upper and lower edges thereof. A central bar is disposed above the main body of the lower piece, over a space dividing the two holder bars. An alternating sequence of concave and convex dimples is formed in a row along the length of the two holder bars, with one sequence beginning with a convex dimple on one holder bar, and the other sequence beginning with a concave dimple on the other holder bar. A plurality of pins arranged in two parallel but staggered rows protrude from the lower surface of the upper piece. Each pin has a rounded head on its lower end. Hair strands are tightly clamped between the rounded heads of the pins and the concave dimples formed on the two holder bars. This serves to prevent the hairclip from sliding.

4 Claims, 4 Drawing Sheets

A-A

B-B

HAIRCLIP

BACKGROUND OF THE PRESENT INVENTION

The present invention relates to an improved structure hairclip, and more particularly to a hairclip that greatly resists sliding.

A common problem facing users of hairclips is the sliding of the hairclip from its initial position on the clamped hair bundle. This is due largely to the fact that the two elongate members which comprise the major components of a conventional hairclip have largely smooth inner surfaces that do not provide sufficient traction on a clamped hair bundle.

This problem is compounded when varying thicknesses of hair bundles must be accounted for. As a conventional hairclip has a pre-determined spacing between its clamping members when in a locked position, a small hair bundle would be loosely held while a large hair bundle, though tightly held, could cause undue tension on the hair strands, leading to user discomfort and possible hair damage.

The hairclip of the present invention overcomes these problems by providing a hair clip with numerous small pins with rounded heads on one clamping member and an equal number of concave, rounded dimples on the other clamping member. A small fraction of the hair strands in a clamped bundle are tightly gripped between the rounded heads of the pins and the round dimples, so that the hairclip is held firmly in place on the hair bundle without any discomfort to the user.

Moreover, the locking mechanism of the hairclip of the present invention has more than one locking position, wherein the space between the two hairclip members can be adjusted. Thus a spacing that best suits a given thickness of a hair bundle can be selected for maximum comfort and effect, with a minimum risk of damage to the hair.

SUMMARY OF THE PRESENT INVENTION

The improved structure hairclip of the present invention has as a first objective to provide a hairclip that is resistant to sliding when clamping a bundle of hair, and a second objective of providing a hairclip that can adjust the spacing between its two component parts to accomodate varying thicknesses of hair bundles.

The improved structure hairclip comprises an elongate and arcuate upper piece and lower piece, connected together at the left ends thereof, by a pair of pivots on the left end of the lower piece, engaged with a respective pair of pivot holes on the left end of the upper piece, rotatably joining the two.

A locking mechanism disposed on the right end of the upper piece has a pair of squeeze tabs on respective sides thereon, each with an attached L-shaped wiper extending between the two squeeze tabs. Each L-shaped wiper has a descending arm that interleaves with the other, with three locking recesses formed on the outer edge of each arm.

By squeezing inwards the two squeeze tabs, the interleaved arms rotate inward, reducing their spanned width so that they can pass through the space between the two flat locking plates of a hasp formed on the right end of the lower piece.

When the squeeze tabs are released, one of three pairs of locking recesses, from each respective arm, is selectively engaged with respective locking plates of the hasp. This locks the upper piece to the lower piece in one of three selectable relative positions, each offering a different spacing between the upper piece and lower piece.

Thus the second objective of the present invention is attained.

A plurality of triangular pins protrude downwards from the lower surface of the upper piece, arranged in two staggered rows, each with the same number of pins to form a zig-zagging configuration. Each pin has a rounded head formed on its lower end.

Two holder bars extend across the mid-section of the lower piece, between the pivot and the hasp, along the upper side and lower side, respectively, and are separated by a space.

A central bar also extends across the mid-section of the lower piece, between the pivots and hasp, but above the main body of the hasp and over the space separating the two holder bars.

An alternating sequence of avoid, convex and concave dimples are formed on the two holder bars with the sequence on one holder bar beginning with a convex dimple and the sequence on the other holder bar beginning with a concave dimple. A row of convex dimples are also formed on the central bar.

The arrangement of concave dimples on the two holder bars forms a zig-zagging configuration that corresponds in position with the zig-zagging configuration of pins on the upper piece.

When the hairpiece clamps a bundle of hair, a small fraction of the hair strands in the hair bundle are gripped tightly between the rounded heads of the pins and the curved surfaces of the concave dimples on the holder bars. This greatly reduces the possibility of the hairclip sliding out of place on the hair bundle, achieving the first objective of the present invention.

Moreover, the rounded surfaces of the pin heads, concave dimples, and convex dimples reduce the possibility of damage to the hair strands in the bundle due to sharp edges.

A complete description of an embodiment of the present invention is given below.

A BRIEF DESCRIPTION OF THE DRAWINGS

FIG. 7 is a schematic view showing a section of the hairclip of

PREFERRED EMBODIMENT OF THE PRESENT INVENTION

Figure 1:
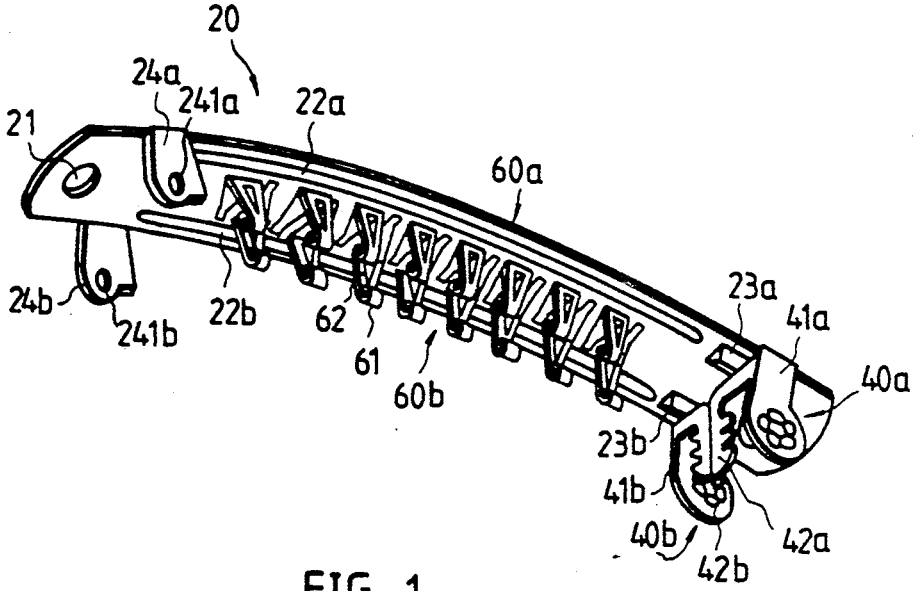
FIG. 1 is a perspective view of the upper piece of the hairclip of the present invention.
Figure 2:
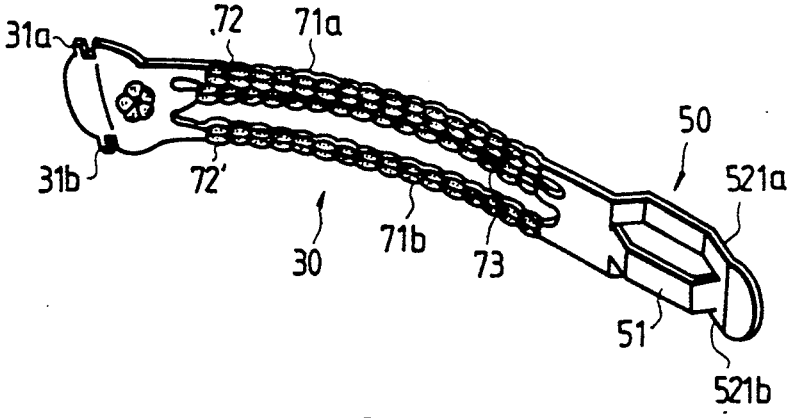
FIG. 2 is a perspective view of the lower piece of the hairclip of the present invention.

Referring to FIGS. 1 and 2, the improved structure hairclip of the present invention comprises elongate and arcuate, upper piece 20 and lower piece 30. Both upper piece 20 and lower piece 30 are manufactured from sheet metal, formed by stamping operations requiring little manual labor.

An attachment hole 21 is formed near the left end of upper piece 20, with another hole (not shown) formed near the opposite end thereof, for the purpose of securing any ornamental adjuncts to the hairclip.

A pair of elongate, reinforcing grooves 22*a* and 22*b* are formed near the respective upper rim and lower rim of upper piece 20, in a medial position between pivot tabs 24*a* and 24*b* to the left, and a pair of locking elements 40*a* and 40*b* to the right. Grooves 22*a* and 22*b* serve to increase the rigidity of upper piece 20.

Similarly, a pair of rectangular indentations 23*a* and 23*b* are formed to the right of respective grooves 22*a* and 22*b*, between a pair of locking elements 40*a* and 40*b*. Indentations 23*a* and 23*b* reinforce the area between locking elements 40*a* and 40*b*, which are subject to bending stresses.

A pair of pivot tabs 24*a* and 24*b* are formed respectively on the upper rim and lower rim of upper piece 20, near attachment hole 21. Pivot tabs 24*a* and 24*b* extend downward, perpendicularly from upper piece 20 and have respective pivot holes 241*a* and 241*b* formed on the lower ends thereof.

Figure 3:
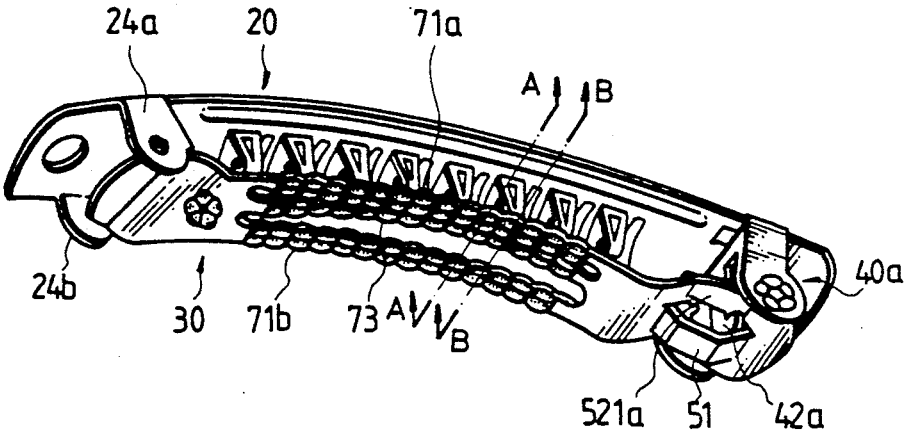
FIG. 3 is a schematic view of the assembled hairclip of the present invention, with the upper piece locked to the lower piece.

A pair of pivots 31*a* and 31*b* are formed on the respective upper rim and lower rim of lower piece 30, near the left end thereof. Pivots 31*a* and 31*b* are positioned in respective pivot holes 241*a* and 241*b* when the hairclip is in assembled form, as shown in FIG. 3.

Locking elements 40*a* and 40*b* are formed near the right end of upper piece 20, on the respective upper rim and lower rim thereof. Locking element 40*a* consists of an outwardly facing squeeze tab 41*a* and an L-shaped wiper 42*a*, as does locking element 40*b* with squeeze tab 41*b* and wiper 42*b*.

Squeeze tabs 41*a* and 41*b* extend downward at nearly a perpendicular angle with respect to the main body of upper piece 20. L-shaped wipers 42*a* and 42*b* are formed, respectively, on the left edges of squeeze tabs 41*a* and 41*b*, extending inwardly at a perpendicular angle therefrom and separated from the bottoms of respective indentations 23*a* and 23*b* by a small distance.

Figure 4:
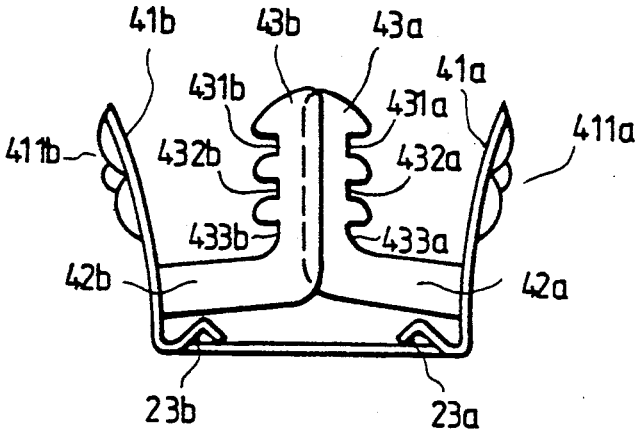
FIG. 4 is a sectional view of the locking mechanism of the hairclip of the present invention taken along line A—A of FIG. 3.

Referring also to FIG. 4, the serrated outer edges of the descending arms 43*a* and 43*b* of respective L-shaped wipers 42*a* and 42*b*, each define a set of three locking recesses 431*a*, 432*a*, and 433*a*, and 431*b*, 432*b*, and 433*b*, respectively.

The respective arms 43*a* and 43*b* of wipers 42*a* and 42*b* interleave, with wiper 42*a* overlapping wiper 42*b* to the left.

A hasp 50 is formed near the right end of lower piece 30, consisting of a depressed, medial base bar 51 and a pair of raised locking bars 52*a* and 52*b*, disposed on each respective side thereof. Locking bars 52*a* and 52*b* have respective, flat locking plates 521*a* and 521*b*, formed on the respective upper portions thereof.

The distance between locking plates 521*a* and 521*b* is less than the lateral distance spanned by wipers 42*a* and 42*b* when in a normal position.

By squeezing together tabs 41*a* and 41*b*, however, wipers 42*a* and 42*b* rotate inwards reducing their span so that arms 43*a* and 43*b* can enter through the gap between locking plates 521*a* and 521*b* and approach base bar 51.

A pair of circular, shallow protrusions 411*a* and 411*b* are formed on the lower ends of respective tabs 41*a* and 41*b* to aid the user in attaining a good grip thereon.

With tabs 41*a* and 41*b* squeezed inwards and upper piece 20 rotating about pivots 31*a* and 31*b* of lower piece 30, arms 43*a* and 43*b* are inserted through the space between locking plates 521*a* and 521*b* by a predetermined depth. Upon release, wipers 42*a* and 42*b* rotate outwards and one of three pairs of locking recesses 431*a* and 431*b*, 432*a* and 432*b*, or 433*a* and 433*b*, is engaged with the inner edges of respective locking plates 521*a* and 521*b*, locking upper piece 20 and lower piece 30 in relative position.

The pair of locking recesses 431*a* and 431*b* are outermost on respective arms 43*a* and 43*b*, with the pair of locking recesses 433*a* and 433*b* being innermost. The two pair of locking recesses, 431*a* and 431*b*, and 433*a* and 433*b*, correspond to the widest and narrowest space between upper piece 20 and lower piece 30, with the pair of locking recesses 432*a* and 432*b* corresponding to a medial space.

This selection allows a user to adjust the space between upper piece 20 and lower piece 30 to suit varying thicknesses of hair bundles.

On the lower surface of upper piece 20 are formed an upper row of eight triangular pins 60*a*, disposed between pivot tab 24*a* and locking element 40*a*, below groove 22*a*. Likewise, a lower row of eight triangular pins 60*b* are formed between pivot tab 24*b* and locking element 40*b*, above groove 22*b*.

The lower row of pins 60*b*, however, are displaced to the left, relative to the upper row of pins 60*a*, by a distance equal to half the space between two adjacent pins 60*a* to form a staggered, zig-zagging configuration.

The lower apex of each triangular pin 60*a* and 60*b* terminates in a curled end 61.

Above each pin 60*a* and 60*b* is a roughly triangular aperture 62 which is an artifact from the stamping operations used to form pins 60*a* and 60*b*.

An elongate holder bar 71*a* is disposed on the upper side of lower piece 30, which extends between the enlarged left end thereof containing pivots 31*a* and 31*b*, and the hasp 50 to the right. A similar holder bar 71*b* is disposed on the lower side of lower piece 30, also between the left end thereof and hasp 50.

Eight substantially avoid, convex dimples 72 and eight substantially avoid, concave dimples 72' are formed along the length of holder bar 71*a*, arranged in an alternating sequence beginning with a convex dimple 72 from the left.

Figure 5:
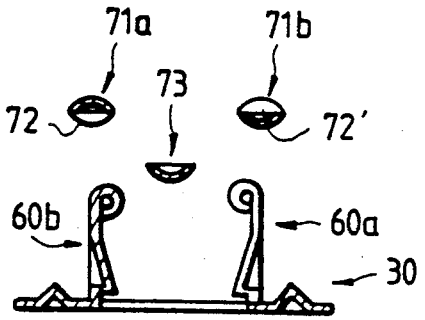
FIG. 5 is a sectional view of the upper piece and lower piece of the present invention, taken along section line B—B of FIG. 3.
Figure 6:
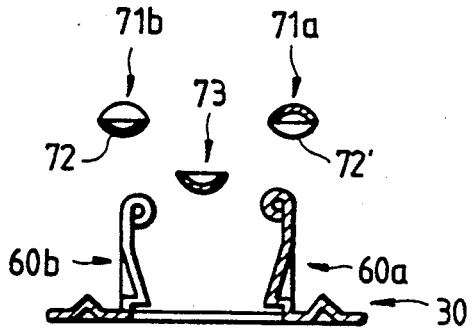
FIG. 6 is a sectional view of the upper piece and lower piece of the present invention.

FIGS. 5 and 6 show cross-sectional views of holder bars 71*a* and 71*b*, taken along the middle of the eight and ninth file of dimples, respectively. They clearly show the alternating sequence of convex dimples 72 and concave dimples 72' on both holder bars 71*a* and 71*b*, and how a convex dimple 72 on one holder bar, 71*a* or 72*b*, is matched by an aligned concave dimple 72' on the other, and vice-versa.

Holder bar 71*b* also has a set of eight concave dimples 72' and eight convex dimples 72 formed along the length thereof in alternating sequence. However, holder bar 71*b* begins its sequence with a concave dimple 72' from the left.

Holder bars 71*a* and 71*b* are separated by a distance slightly greater than the width of either. A third holder bar 73, of similar curvature to holder bars 71*a* and 71*b* is disposed above the main body of lower piece 30, over the space between holder bars 71*a* and 71*b*.

Holder bar 73 adjoins with the main body of lower piece 30, to the left and right side thereof, through a pair of sloping, curved joining bars 731*a* and 731*b*, respectively.

Sixteen convex dimples 72 are formed along the length of holder bar 73, which, as can be seen in FIGS. 5 and 6, are aligned in file with convex dimples 72 and concave dimples 72' of respective holder bars 71*a* and 71*b*.

Figure 7:
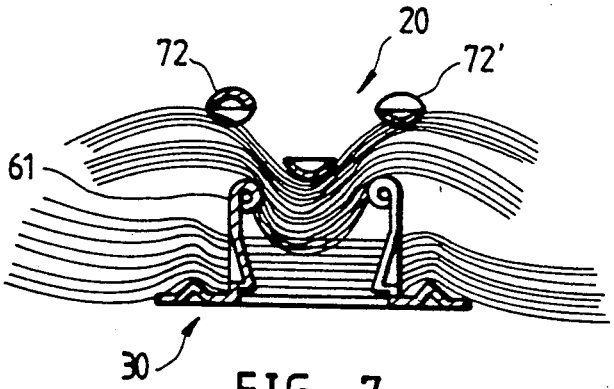
Figure 8:
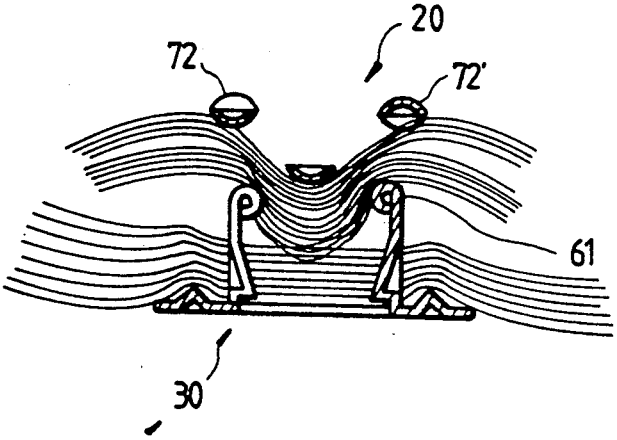
FIG. 8 is also a schematic view showing a section of the hairclip of the present invention clamping a bundle of hair.

Referring to the cross-sectional view of FIG. 7, a bundle of hair is shown clamped by the hairclip of the present invention with upper piece 20 locked to lower piece 30.

Note that a small fraction of the hair strands in the hair bundle are tightly clamped between the curled ends 61 of triangular pins 60*a* and 60*b* and the concave dimples 72' of holder bars 71*a* and 71*b*.

This arrangement greatly aids in preventing the hairclip from sliding by tightly gripping only a small portion of the hairs in the bundle, without any undue tension on the remaining majority so as to still allow comfortable wear.

The rounded surfaces of concave dimples 72' and curled ends 61 also prevent the knicking or sharp kinking of hair strands that leads to eventual breakage, an important advantage, especially for female users with long hair.

Furthermore, the convex dimples 72 on holder bars 71*a*, 71*b*, and 73 present a larger area to hair strands than a simple flat surface, also serving to increase the traction on the hair bundle by contacting more hair strands over a larger area. More importantly, they guide the hair strands around the sharp metal edges of holder bars 71*a*, 71*b*, and 73 so as to prevent knicking and kinking, which a flat surface would, of course, not provide.

I claim:

1. An improved structure hair-clip comprising an, elongate and arcuate, upper piece and lower piece, wherein:

two pivot holes are formed near one end of said upper piece;

two pivots, formed on one end of said lower piece, are disposed within respective said pivot holes to rotatably secure said upper piece to said lower piece;

a locking means includes at least one locking protrusion and more than one locking catches, said locking catches being disposed near an end of said upper piece opposite from said pivot holes, and said locking protrusion is disposed near an end of said lower piece opposite from said pivots;

a plurality of protruding pins are formed on the lower surface of said upper piece, arranged in two rows disposed near a respective upper edge and lower edge of said upper piece, extending between said pivot holes and said locking catches, said protruding pins extend downwards from the lower surface of said upper piece and have a rounded termination formed on the lower ends thereof;

a plurality of concave, avoid dimples, of equal number with said protruding pins, are formed on the upper surface of said lower piece, arranged in two rows disposed on two respective holder bars, formed on the respective upper edge and lower edge of said lower piece, extending between said pivots and said locking protrusion;

a central bar is disposed above the upper surface of said lower piece, over the space between the two said holder bars, adjoining with the main body of said lower piece through a pair of arcuate, sloping connecting bars to the respective left end and right end of said central bar;

whereby, said upper piece and said lower piece can clamp a hair bundle with a selected locking catch on said upper piece engaging said locking protrusion on said lower piece to releasably lock said upper piece in relative position to said lower piece, different selected said locking catches providing different spacings between said upper piece and said lower piece to accomodate varying thicknesses of hair bundles;

each said protruding pin of the two said rows on said upper piece approaches a corresponding said concave dimple on respective holder bars of said lower piece, tightly clamping a small percentage of the hair strands of the hair bundle between said rounded terminations of said protruding pins and the avoid surfaces of said concave dimples, increasing the resistance of the hairclip to sliding while preventing damage to tightly gripped hair strands, due to the curved surfaces of said terminations of said pins and said dimples on said holders.

2. An improved structure hairclip according to claim 1, wherein:

said protruding pins, arranged in two said rows, have equal inter-pin distances between said adjacent said pins on each said row;

the two said rows of said protruding pins on said upper piece are displaced laterally, relative to each other, by a distance equal to half of said inter-pin distance, to form a zig-zagging configuration;

the two said rows of said concave dimples of said holder bars are, likewise, displaced laterally relative to each other, by a distance equal to half the distance between adjacent said concave dimples on a said holder bar, in a zig-zagging configuration that conforms with the positions of said rounded terminations on said pins.

3. An improved structure hairclip according to claim 2, wherein:

a plurality of avoid, convex dimples are formed on the two said holder bars, in the space between adjacent said concave dimples, equal in number with the number of said concave dimples, so that said holder bars each have an alternating sequence of said convex dimples and said concave dimples;

a plurality of said convex dimples are formed on said central bar, disposed along the length thereof;

whereby, the curved surface of said convex dimples on the two said holder bars and said central bar guide hair strands away from the sharp edges of said central bar and said holder bars, preventing damage of the hair strands, furthermore the curved surfaces of said convex dimples present a larger contact area to the hair strands, contacting more hair strands and over a larger area thereon, to increase traction and further aid in preventing sliding of the hairclip.

4. An improved structure hairclip according to claim 2 wherein said locking means comprises:

a pair of squeeze tabs, formed respectively on the upper edge and lower edge of said upper piece, near an end thereof, opposite from said pivot holes, and extending downwards at nearly a perpendicular angle therefrom;

an L-shaped wiper, formed on each said squeeze tab, on an edge thereon, extending inwards at a perpendicular angle, under the lower surface of said upper piece;

an arm of each said wiper extends downward, with a substantial portion of each said arm touching and interleaving the other;

more than one locking recesses, formed on the outer edges of each said arm, the number and relative positions of said locking recesses being the same for both said arms, corresponding pairs of said locking recesses from respective said arms define said locking catches;

wherein, said locking protrusion comprises a substantially flat locking bar, a respective said locking bar being formed on the upper edge and lower edge of said lower piece, near an end thereof, opposite from said pivots, said locking bars being separated by a space of width less than the width spanned by said arms of said wipers when in a normal position;

whereby, said wipers can be rotated inwardly by applying inward pressure on said squeeze tabs, reducing the width spanned by said arms to allow said arms to pass through the space between said bars by a selected pre-determined distance;

upon release of said squeeze tabs, said arms of said wipers rotate outwardly, engaging a selected said pair of locking recesses with the respective inner edges of said locking bars, locking said upper piece and said lower piece in relative position.

* * * * *